United States Patent [19]

Teramoto et al.

[11] Patent Number: 4,890,804

[45] Date of Patent: Jan. 2, 1990

[54] TURNOUT UNIT FOR RAILWAY TRACK

[75] Inventors: Tomihiko Teramoto; Hidehiko Ono, both of Nagoya; Sadanobu Ito; Kiyoshi Nishino, both of Tokyo, all of Japan

[73] Assignees: Nippon Sharyo Seizo Kabushiki Kaisha, Nagoya; Kanto Bunkiki Kabushiki Kaisha, Tokyo, both of Japan

[21] Appl. No.: 146,676

[22] Filed: Jan. 21, 1988

[30] Foreign Application Priority Data

Jan. 22, 1987 [JP] Japan ..... 61-8074[U]
Aug. 21, 1987 [JP] Japan ..... 61-127191[U]

[51] Int. Cl.[4] ..... E01B 7/00

[52] U.S. Cl. ..... 246/453; 246/380; 246/392; 104/102; 104/130

[58] Field of Search ..... 246/453, 430, 434, 435 R, 246/380, 381, 392; 238/264, 282, 331; 104/102, 103, 130; 427/427; 228/122

[56] References Cited

U.S. PATENT DOCUMENTS

| | | | |
|---|---|---|---|
| 3,922,444 | 11/1975 | Nakamura | 427/427 X |
| 4,598,025 | 7/1986 | Mizuhara | 228/122 X |
| 4,614,673 | 9/1986 | Bendig | 427/427 X |

FOREIGN PATENT DOCUMENTS

| | | | |
|---|---|---|---|
| 61945 | 10/1982 | European Pat. Off. | 246/380 |
| 232726 | 8/1987 | European Pat. Off. | 246/453 |
| 2856850 | 7/1980 | Fed. Rep. of Germany | 246/430 |

*Primary Examiner*—Johnny D. Cherry
*Assistant Examiner*—Dean J. Kramer
*Attorney, Agent, or Firm*—Armstrong, Nikaido Marmelstein, Kubovcik & Murray

[57] ABSTRACT

Disclosed is an improved turnout unit to be employed in turnout point of railway tracks, which does not necessitate maintenance of the sliding surface of the base plate. In the turnout unit of the present invention, a spray-coated ceramic layer is formed on the base plate and the tongue rail slides on the ceramic layer.

9 Claims, 7 Drawing Sheets

TURNOUT UNIT FOR RAILWAY TRACK

BACKGROUND OF THE INVENTION

I. Field of the Invention

This invention relates to a turnout unit for railway tracks, and more particularly, this invention relates to a turnout unit which has an improved sliding surface on which a tongue rail slides.

II. Description of the Prior Art

Turnout points are the most important parts of railway tracks from the point of view of track safety and their upkeep is a key item in rail track maintenance.

In general, turnout point construction comprises a tongue rail which slides on a base plate made of steel. In order to ensure smooth sliding of the tongue rail, it is necessary to keep the base plate well lubricated. Thus, it is necessary to periodically apply lubricating oil to the sliding surface of the base plate.

To eliminate this periodical application of lubricating oil, it was proposed in Japanese Utility Model Disclosure (Kokai) Nos. 140507/77 and 125501/84 to embed a solid lubricant in the sliding surface of the base plate.

However, the solid lubricant has an unsatisfactory weatherability and wear resistance. Further, since the solid lubricant is embedded in a copper alloy layer formed on the base plate made of steel, manufacturing of the structure is laborious and costly.

SUMMARY OF THE INVENTION

Accordingly, the object of the present invention is to provide a tournout unit which eliminates the necessity of periodical application of lubricant, of which sliding surface for the tongue rail has an excellent weatherability and wear resistance, and which is easy to manufacture.

It was found by the present inventors that the above-mentioned object of the present invention may be accomplished by forming on the base plate a spray-coated ceramic layer serving as a sliding surface for the tongue rail. Thus, the present invention provides a tournout unit comprising a base plate, a stock rail fixed on the base plate, a spray-coated ceramic layer formed on the base plate, and a tongue rail slidably mounted on the ceramic layer, the tongue rail sliding on the ceramic layer.

According to the present invention, the spray-coated ceramic layer ensures the smooth sliding of the tongue rail, so that periodical application of a lubricant to the base plate is not necessary. The ceramic layer has an excellent weatherability and wear resistance. Since the ceramic layer may be formed by a spray-coating method, the ceramic layer may be formed easily.

BRIEF DESCRIPTION OF THE DRAWINGS

FIGS. 2 to 4 show a first embodiment of the turnout unit of the present invention wherein FIG. 2 is a cross-sectional view taken along the line II—II in FIG. 1, FIG. 3 is a plan view of the turnout unit shown in FIG. 2, from which the stock rail, the tongue rail, the rail holder and the like are removed for the purpose of clarity, and FIG. 4 is a cross-sectional view taken along the line IV—IV in FIG. 3;

FIGS. 5 to 7 show a second embodiment of the turnout unit of the present invention wherein FIG. 5 is a cross-sectional view corresponding to FIG. 2, FIG. 6 is a plan view of the turnout unit shown in FIG. 5, from which the stock rail, the tongue rail, the rail holder and the like are removed for the purpose of clarity, and FIG. 7 is a cross-sectional view taken along the line VII—VII in FIG. 6;

FIGS. 8 and 9 show a third embodiment of the turnout unit of the present invention wherein FIG. 8 is a plan view of the turnout unit from which the stock rail, the tongue rail, the rail holder and the like are removed for the purpose of clarity, and FIG. 9 is a cross-sectional view taken along the line IX—IX in FIG. 8;

FIGS. 10 to 12 show a fourth embodiment of the turnout unit of the present invention wherein FIG. 10 is a plan view of the turnout unit from which the stock rail, the tongue rail, the rail holder and the like are removed for the purpose of clarity, FIG. 11 is a longitudinal sectional views taken along the line XI—XI in FIG. 10, and FIG. 12 is a cross-sectional view taken along the line XII—XII in FIG. 10;

FIGS. 13 to 15 show a fifth embodiment of the turnout unit of the present invention wherein FIG. 13 is a plan view of the turnout unit from which the stock rail, the tongue rail, the rail holder and the like are removed for the purpose of clarity, FIG. 14 is a longitudinal sectional view taken along the line XIV—XIV in FIG. 13, and FIG. 15 is a cross-sectional view taken along the line XV—XV in FIG. 13; and FIGS. 16 and 17 show a sixth embodiment of the turnout unit of the present invention wherein FIG. 16 is a plan view of the turnout unit from which the stock rail, the tongue rail, the rail holder and the like are removed for the purpose of clarity, and FIG. 17 is a longitudinal sectional view taken along the line XVII—XVII in FIG. 16.

DETAILED DESCRIPTION OF THE PREFERRED EMBODIMENTS

Figure 1:
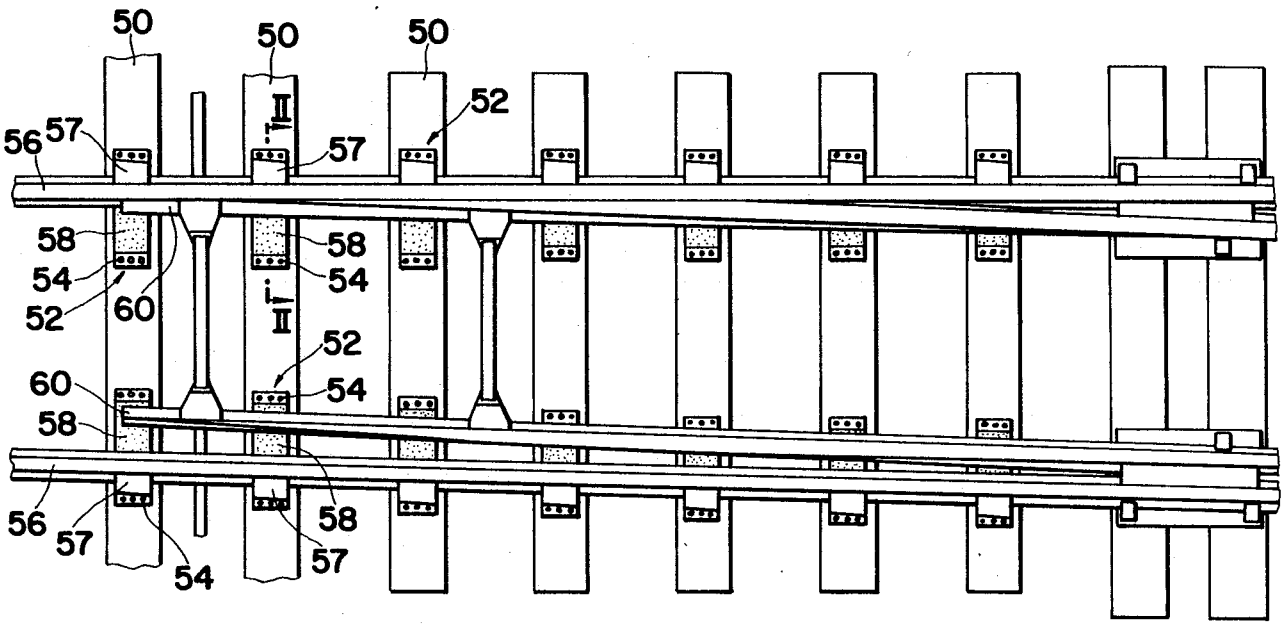
FIG. 1 shows a turnout point structure in which the turnout units of the present invention are employed.

The turnout unit of the present invention, like a conventional tournout unit, has a base plate and a stock rail fixed thereto. Although not restricted, the base plate is usually made of steel. The stock rail is usually fixed to the base plate by a conventional rail holder. A spray-coated ceramic layer serving as a sliding surface is formed on the base plate, and a tongue rail is slidably mounted on the ceramic layer, which tongue rail slides on the ceramic layer.

The most characteristic feature of the tournout unit of the present invention is that it has the spray-coated ceramic layer formed on the base plate, which serves as a sliding surface for the tongue rail. The ceramic layer should have excellent weatherability and wear resistance. In a preferred embodiment, the spray-coated ceramic layer consists essentially of an $Al_2O_3$-based ceramic. In the most preferred embodiment, the ceramic layer consists essentially of 80–100% by weight of $Al_2O_3$ and 20–0% by weight of Ni and Al, the Ni to Al wight ratio being 80:20 to 95:5, or the ceramic layer consists essentially of 80–95% by weight of $Al_2O_3$ and 20–5% by weight of Ni, Cr and Al, the weight ratio of Ni:Cr:Al being, for example, 75:20:5. By incorporating these metals in the ceramic layer, the adhesiveness with the base plate or a bonding coat layer (hereinafter described in detail) may be promoted. Further, the hardness or brittleness may be reduced, and the tenacity of the ceramic layer is increased. The ceramic layer may preferably be porous, and lubricating oil may be impregnated in the porous ceramic. By impregnating the lubricating oil in the porous ceramic layer, the smoothness of the ceramic layer is further promoted. The thickness of the ceramic layer may preferably be 0.2 mm to 0.4 mm. The ceramic layer is formed by spray-coating method which is well-known in the art.

Although it is possible to form the spray-coated ceramic layer directly on the steel base plate, it is preferred that an bonding coat layer be formed on the base plate and the ceramic layer be formed on the bonding coat layer. The bonding coat layer may be formed of a metal having a good adhesiveness with the ceramic layer and the steel base plate. The bonding coat layer may preferably be made of a Mo-based metal, and in the most preferred embodiment, the bonding coat layer consists essentially of 80–100% by weight of Mo and 20–0% by weight of Ni and Al, the Ni to Al weight ratio being, for example, 80:20 to 95:5, or the bonding coat layer consists essentially of 80–100% by weight of Mo and 20–0% by weight of Ni, Cr and Al, the weight ratio of Ni:Cr:Al being, for example, 75:20:5. By incorporating Ni, Al (and Cr), the adhesiveness with the steel and ceramic may be increased, the binding force among Mo metal particles may be strengthened and the brittleness of the Mo metal may be reduced. The thickness of the bonding coat layer may be, for example, about 0.10 mm to 0.30 mm. The bonding coat layer may also be formed by a spray coating method which is well-known.

Preferred embodiments of the present invention will now be described referring to the drawings.

Figure 2:
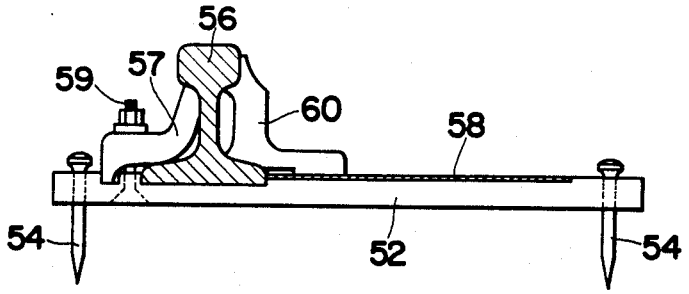

Referring to FIGS. 1 and 2, a typical tournout point structure in which a plurality of the tournout units of the present invention are employed is shown in FIG. 1. The turnout unit of the present invention, like a conventional turnout unit, has a base plate 52 (see FIG. 2) fixed to a switch sleeper 50. The base plate 52 is fixed to the switch sleeper typically by dog spikes 54. A stock rail 56 is fixed to the base plate 52 by a rail holder 57 which is fixed to the base plate 52 by a bolt 59. A spray-coated ceramic layer 58 is formed on the base plate 52, and a tongue rail 60 is slidably mounted on the ceramic layer 58. When the turnout point is switched, the tongue rail 60 slides on the ceramic layer 58.

Figure 3:
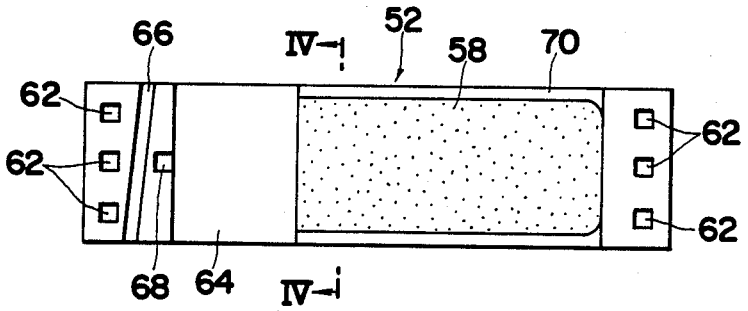
Figure 4:
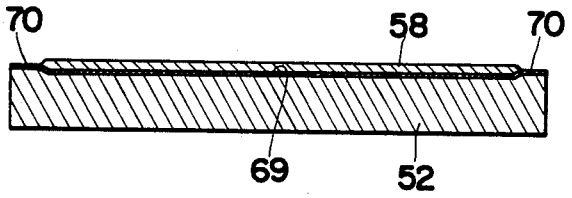

FIG. 3 shows the base plate structure employed in the turnout unit shown in FIG. 2, and FIG. 4 shows a cross-sectional view taken along the line IV—IV in FIG. 3. The base plate structure shown in FIG. 3 has through holes 62 at the both end portions thereof, in which dog spike 54 is inserted. A stock rail-receiving hollow 64 for receiving the base portion of the stock rail 56 is formed in the base plate. Further, a groove 66 for receiving the base portion of the rail holder 57 and a through hole 68 in which the bolt 59 is inserted are formed. Referring to FIG. 4, a shallow recess 69 having a depth of, for example, about 0.3 mm to 0.7 mm is formed in the base plate 52, and the above-mentioned bonding coat layer 70 is formed on the recess 69 and on the non-recessed portions of the base plate 52. The ceramic layer 58 is spray-coated on the portion of the bonding coat layer 70, which is formed on the recess 69 of the base plate 52. In this embodiment, the upper surface of the ceramic layer 58 is made flush with, or is slightly protruded from the upper surface of the bonding coat layer 70 formed on the non-recessed portions of the base plate 52.

Figure 5:
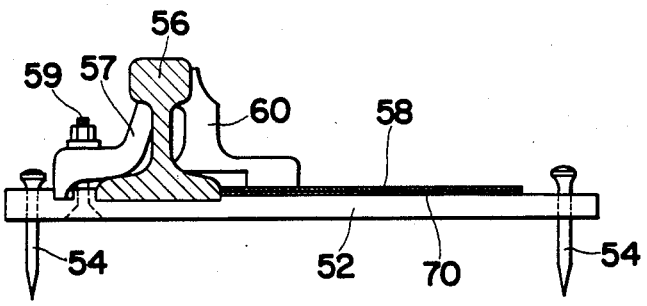
Figure 6:
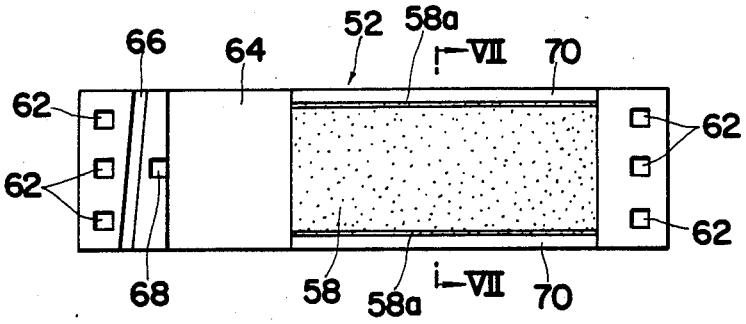
Figure 7:
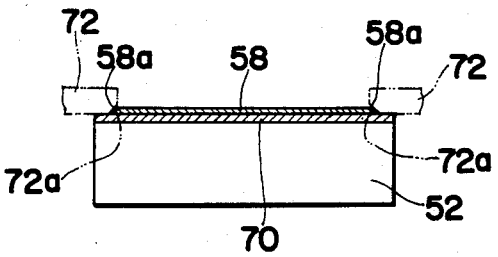

FIGS. 5 to 7 show another preferred embodiment. Like reference numerals are employed for designating like elements shown in FIGS. 2 to 4. In this embodiment, a recess is not formed in the base plate 52, but instead, the ceramic layer 58 has tapered edges **58*a* (see FIG. 7). The taper is formed such that the upper surface of the ceramic layer is smaller than the base surface thereof. Such a ceramic layer having the tapered edges may be formed by employing a mask 72 having a reverse-tapered edge 72*a* and spray-coating the ceramic layer 58 on the bonding coat layer 70 while covering the edge portion of the bonding coat layer 70 with the mask 72. Since the sprayed ceramic reaches the portion under the reverse-tapered edge 72*a*, the tapered edges 58*a* are formed. By providing the ceramic layer 58 with the tapered edges 58*a*, peeling off of the ceramic layer 58** may be prevented.

Figure 8:
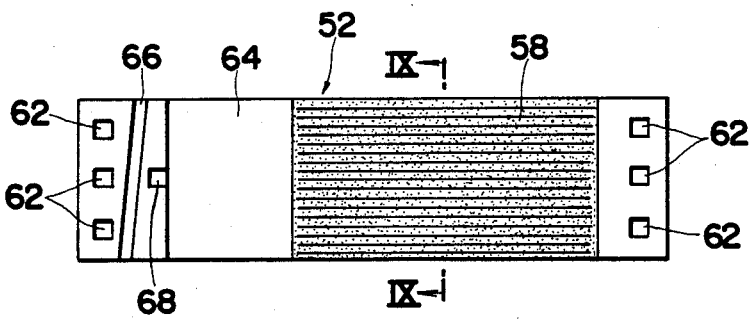
Figure 9:
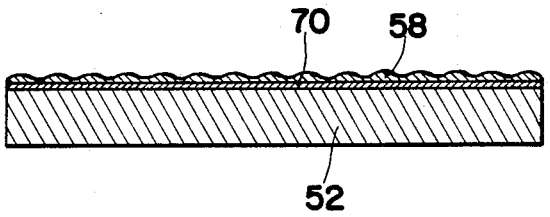

Another preferred embodiment of the present invention is shown in FIGS. 8 and 9. In this embodiment, the spray-coated layer 58 has a waveform. By providing the wave-shaped ceramic layer 58, the friction between the ceramic layer 58 and the tongue rail 60 is further reduced because the friction surface area is reduced, and the amount of ceramic material used for forming the ceramic layer 58 may be reduced.

Figure 10:
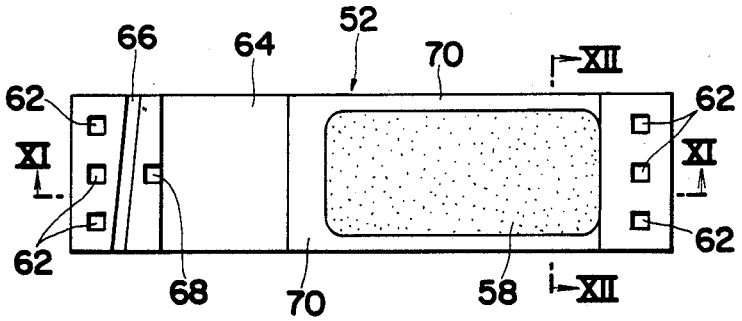
Figure 11:
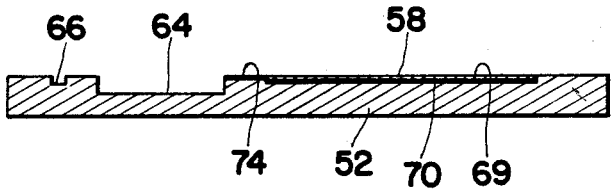
Figure 12:
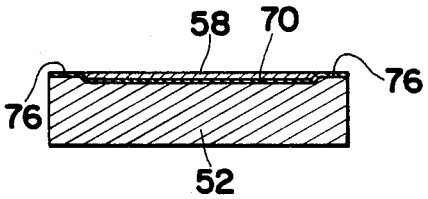

Still another preferred embodiment is shown in FIGS. 10 to 12. In this embodiment, like the embodiment described referring to FIGS. 2 to 4, a recess 69 is formed in the base plate 52, but a substantially non-recessed portion 74 exists between the hollow 64 for receiving the stock rail and the recess 69, and substantially non-recessed portions 76 exist along the longitudinal edge of the base plate. The bonding coat layer 70 is formed on the recess 69 and on the substantially non-recessed portions 74 and 76, and the ceramic layer 58 is formed on the bonding coat layer 70 on the recess 69, such that the upper surface of the ceramic layer 58 is made flush with the upper surface of the bonding coat layer 70 formed on the substantially non-recessed portions 74 and 76 of the base plate 52. The width of the unrecessed portion 74 may be, for example, 20 mm to 40 mm, and that of the unrecessed portion 76 may be, for example, 10 mm to 20 mm. By employing this structure, the ceramic layer 58 may be prevented from being peeled off.

Figure 13:
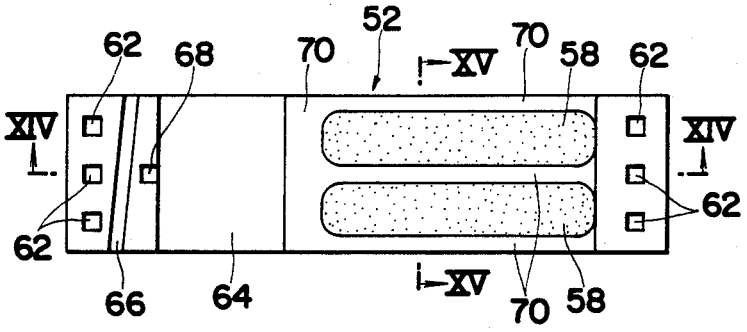
Figure 14:
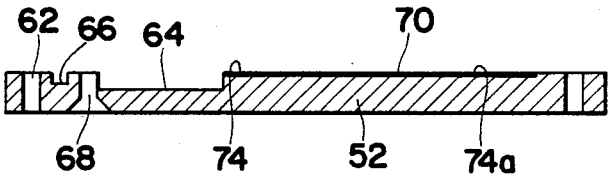
Figure 15:
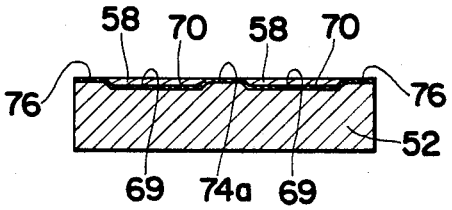

Still another embodiment is shown in FIGS. 13 to 15. Like the embodiment shown in FIGS. 10–12, the base plate 52 has a substantially non-recessed portion 74 between the stock rail-receiving hollow 64 and the ceramic layer 58, and substantially non-recessed portions 76 along the longitudinal edge thereof. However, in this embodiment, the substantially non-recessed portion 74 has an extension **74*a* which extends in the ceramic layer 54 and which is substantially parallel to the non-recessed portions 76 so that the ceramic layer 58 is separated into two portions. The width of the extension 74*a* may be, for example, 10 mm to 20 mm. The upper surface of the ceramic layer 58 is made flush with the upper surface of the bonding coat layer 70 formed on the non-recessed portions 74, 74*a* and 76. By employing this structure, prevention of the peeling off of the ceramic layer may be further promoted, and the material forming the ceramic layer 58** may be saved.

Figure 16:
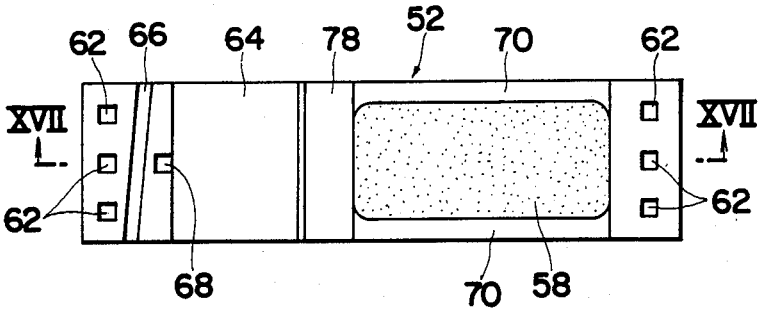
Figure 17:
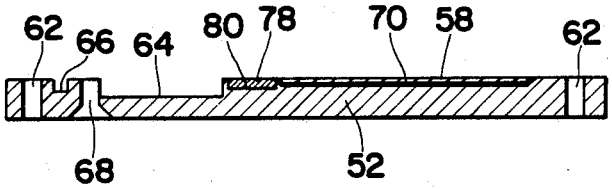

Still another preferred embodiment of the present invention is shown in FIGS. 16 and 17. This embodiment is similar to the embodiment described referring to FIGS. 10 to 12, but in this embodiment, a groove 80 is formed in the base plate 52 between the recess 69 and the hollow 64, and a hard metal 78 such as stainless steel is embedded in the groove 80 by overlay welding, such that the upper surface of the metal is made flush with the upper surface of the ceramic layer 58. The depth of the groove 80 may be, for example, 2 mm to 3 mm. Since the hard metal 78 receives the shock given by the tongue rail, the prevention of the ceramic layer 58 from being peeled off is further promoted.

Although the invention is described based on the specific embodiments thereof, it is apparent for those skilled in the art that many modification may be made without departing from the spirit and scope of the present invention. Thus, it is understood that the above description should not be interpreted restrictively.

We claim:

1. A turnout unit, comprising:

a base plate;

a stock rail fixed on said base plate;

a spray-coated ceramic layer formed on said base plate;

a tongue rail slidably mounted on said ceramic layer, said tongue rail sliding on said ceramic layer;

a bonding coat layer interposed between said base plate and said spray-coated ceramic layer, said bonding coat layer being made of a metal, wherein said base plate includes a recessed portion with substantially non-recessed portions existing between said stock rail and said recessed portion and along longitudinal edges of said base plate, said bonding coat layer being formed on said recessed portion and said non-recessed portions, and further wherein said spray-coated ceramic layer is formed on a portion of said bonding coat layer formed on said recessed portion such that an upper surface of said ceramic layer is made substantially flush with an upper surface of said bonding coat layer formed on the non-recessed portions of said base plate.

2. The turnout unit of claim 1, wherein the spray-coated ceramic layer consists essentially of an $Al_2O_3$-based ceramic.

3. The turnout unit of claim 2, wherein the $Al_2O_3$-based ceramic contains at least one member selected from the group consisting of Ni metal powder and Al metal powder in an amount of up to 20% by weight.

4. The turnout unit of claim 1, wherein the metal is a MO-based metal.

5. The turnout unit of claim 4, wherein the Mo-based metal contains at least one member selected from the group consisting of Ni and Al in an amount of up to 20% by weight.

6. The turnout unit of claim 1, wherein the spray-coated ceramic layer is porous and a lubricating oil is impregnated in the ceramic layer.

7. The turnout unit of claim 1, further comprising a hard metal embedded in the base plate adjacent to the stock rail, the hard metal being embedded by overlay welding.

8. The turnout unit of claim 1, wherein the spray-coated ceramic layer has a taper at the longitudinal edges thereof.

9. The turnout unit of claim 1, wherein the spray-coated ceramic layer has a waveform.

* * * * *